US009403616B2

(12) United States Patent
Vergés Escuín

(10) Patent No.: US 9,403,616 B2
(45) Date of Patent: Aug. 2, 2016

(54) LAMINAR BLANK FOR ASSEMBLING POLYHEDRA, CORRESPONDING POLYHEDRON AND METHOD OF ASSEMBLY

(71) Applicant: Ricardo Vergés Escuín, Vejer De la Frontera (ES)

(72) Inventor: Ricardo Vergés Escuín, Vejer De la Frontera (ES)

( * ) Notice: Subject to any disclaimer, the term of this patent is extended or adjusted under 35 U.S.C. 154(b) by 0 days.

(21) Appl. No.: 14/410,328

(22) PCT Filed: Jun. 27, 2013

(86) PCT No.: PCT/ES2013/070431
§ 371 (c)(1),
(2) Date: Dec. 22, 2014

(87) PCT Pub. No.: WO2014/006247
PCT Pub. Date: Jan. 9, 2014

(65) Prior Publication Data

US 2015/0314909 A1 Nov. 5, 2015

(30) Foreign Application Priority Data

Jul. 2, 2012 (ES) ..... 201231027

(51) Int. Cl.
*B65D 5/22* (2006.01)
*F21V 1/12* (2006.01)
*F21S 2/00* (2016.01)
(Continued)

(52) U.S. Cl.
CPC ..... *B65D 5/2033* (2013.01); *B31B 3/00* (2013.01); *B65D 5/22* (2013.01); *B65D 5/321* (2013.01); *F21S 2/005* (2013.01); *F21S 8/061* (2013.01); *F21V 1/12* (2013.01); *F21Y 2101/00* (2013.01); *F21Y 2101/02* (2013.01)

(58) Field of Classification Search
CPC ..... B65D 5/2033; B65D 5/22; B65D 5/2028; B65D 5/427; F21V 1/12
USPC ..... 229/116.1, 109, 110, 120.01; 273/153 P, 273/157 R
See application file for complete search history.

(56) References Cited

U.S. PATENT DOCUMENTS 559,050 A * 4/1896 Carman ..... B65D 5/029 229/108
2,468,951 A 5/1949 Barter
(Continued)

FOREIGN PATENT DOCUMENTS

DE 27 27 136 A1 12/1978
DE 89 07 462 U1 8/1989
(Continued)

*Primary Examiner* — Gary Elkins
(74) *Attorney, Agent, or Firm* — McGrew and Tuttle, P.C.

(57) ABSTRACT

The present invention relates to a laminar blank for assembling polyhedra which comprises at least three arrises (2*a*, 2*b*). Each of the arrises (2*a*, 2*b*) comprises: a first tab (4) projecting from the arris (2*a*, 2*b*) and forming a fold line, at least two closure grooves (12) provided in said arris (2*a*, 2*b*), a second fold-in tab (6) projecting from the first tab (4) and forming at least one fold-in line (30), a closure flange (10) projecting from the second tab (6) and aligned with a closure groove (12), and a third tab (8) projecting from one of the side edges (22) of the first tab (4) and being foldable with respect to the first tab (4) for cooperating with the adjacent arris (2*b*). The invention also relates to a polyhedron formed from laminar blanks according to the invention, as well as to a method of assembly.

10 Claims, 5 Drawing Sheets

(51) Int. Cl.

| | |
|---|---|
| ***F21S 8/06*** | (2006.01) |
| ***B65D 5/20*** | (2006.01) |
| ***B31B 3/00*** | (2006.01) |
| ***B65D 5/32*** | (2006.01) |
| *F21Y 101/02* | (2006.01) |
| *F21Y 101/00* | (2016.01) |

(56) References Cited

U.S. PATENT DOCUMENTS 3,571,958 A * 3/1971 Stevens ..... B65D 5/2033 40/124.14
3,666,607 A * 5/1972 Weissman ..... B65D 5/008 229/108
4,050,184 A * 9/1977 Chiari ..... A63H 33/101 273/157 R
4,640,456 A * 2/1987 Stacey ..... B65D 5/22 229/122
4,682,726 A 7/1987 Drueck, Jr.
4,742,915 A 5/1988 Ringer
6,244,501 B1 * 6/2001 Choi ..... B65D 5/009 220/23.2
7,389,908 B2 * 6/2008 Cohen ..... B65D 5/008 206/459.5
8,061,713 B2 * 11/2011 Cook ..... A63F 9/1204 273/156
2008/0197566 A1 * 8/2008 Lee ..... A63F 9/1208 273/157 R
2009/0196050 A1 * 8/2009 Chiang ..... F21V 1/12 362/311.13
2011/0080114 A1 4/2011 Elberbaum et al.

FOREIGN PATENT DOCUMENTS

DE 19652581 A1 * 7/1997 ..... B65D 5/2033
EP 1 136 367 A2 9/2001
WO 03033224 A2 4/2003

* cited by examiner

LAMINAR BLANK FOR ASSEMBLING POLYHEDRA, CORRESPONDING POLYHEDRON AND METHOD OF ASSEMBLY

FIELD OF THE INVENTION

The invention relates to a laminar blank for forming polyhedra which comprises at least three arrises.

The invention also relates to a polyhedron assembled from a plurality of blanks according to the invention and to a method of assembling polyhedra.

STATE OF THE ART

Building polyhedra from laminar templates defining the sides of the polyhedron is known. These templates show the planar development of the polyhedron indicating the fold lines. In these templates the different sides of the polyhedron are attached to one another.

Document WO200333224 discloses a method for manufacturing containers, balls or the like from a laminar template defining the sides of a truncated icosahedron. The attachment between contiguous arrises is complicated and requires an additional fixing element, such as an adhesive or the like, between sides. Furthermore, the icosahedron resulting from the laminar template can easily collapse if one or several of its sides are subjected to a compressive stress directed towards the center of the polyhedron.

It must also be pointed out that the preformed templates of the developed polyhedron are not at all versatile, i.e., only the polyhedron for which the template is envisaged can be assembled.

DESCRIPTION OF THE INVENTION

The purpose of the invention is to provide a laminar blank of the type indicated above for assembling polyhedra which allows assembling regular or irregular polyhedra in a versatile manner, without needing to use any type of additional attachment element other than the blank itself, and nevertheless obtaining a solid and stable assembled polyhedron.

This purpose is achieved by means of a laminar blank of the type indicated above for assembling polyhedra, characterized in that each of the arrises of the laminar blank comprises: [a] a first fold tab projecting from the arris, extending along the entire length of the arris to form a fold line, [b] at least two closure grooves provided in the arris, [c] a second fold-in tab projecting from the free edge of the first tab facing the arris and extending partially along said free edge to form at least one fold-in line, [d] a closure flange projecting from the free edge of the second tab facing the first tab and extending partially along said free edge, the closure flange being arranged aligned with one of the closure grooves, and [e] a third tab projecting from one of the side edges of the first tab which has a length of at least one third the length of the adjacent arris and is foldable with respect to the first tab for cooperating with the adjacent arris.

The flanges allow attaching adjacent blanks to one another without needing to use any additional adhesive-type element or other external attachment means. On the other hand, in a polyhedron formed from a plurality of blanks according to the invention, when a compressive stress is applied towards the center of the polyhedron, the third tab is responsible for transmitting the derived bending stresses towards the vertices of the arris on which it is articulated, from where the stresses are in turn distributed towards the adjacent blanks. This device converts the polyhedron into a closed and non-deformable hyperstatic structure.

Furthermore, the invention comprises a series of preferred features which are object of the dependent claims and the usefulness of which will be highlighted below in the detailed description of an embodiment of the invention.

The second fold-in tab is preferably adjacent to the third tab to better support the tensile stress generated by the third tab of the adjacent arris. Particularly, the farther away the support point of the third tab is on the second tab of the contiguous arris, the greater the supportable stresses will be.

The third tab preferably has a length equal to the length of the adjacent arris, which hinders the third tab from being able to move out of its position and therefore allows supporting greater stress on the corresponding arris.

In a particularly preferred manner, said closure flange is as wide as said closure groove and comprises retaining grooves on each side of said flange forming retaining fingers, and said retaining fingers are symmetrical and converge in the direction away from said base and can be raised for attaching said closure flange with the respective closure groove in a form-fit connection. This allows transmitting the stresses to the adjacent arrises, not by ball-and-socket effect, but rather by the continuity of an insertion.

Alternatively, the base of said closure flange is also wider than said closure groove, comprises retaining notches on each side of said flange, and said notches are symmetrical for attaching said closure flange with the respective closure groove in a form-fit connection.

The invention also relates to a polyhedron comprising a plurality of blanks according to the invention. As will be seen below, the interaction between contiguous blanks allows distributing stresses such that the compressive strength of the polyhedron is increased.

Furthermore in a particularly preferred manner, the blanks of the polyhedron are translucent or transparent and at least one of the blanks of the plurality of blanks comprises an opening suitable for assembling lighting means which allows manufacturing hanging lamps or table lamps. Furthermore in the absence of the opening, the polyhedra according to the invention can be used to manufacture toy spheres or domestic gadgets, not to mention possible applications for educational, business or industrial use.

Furthermore, the invention relates to a method of assembling a polyhedron from a plurality of laminar blanks according to the invention. To that end, the method comprises the steps consisting of: [a] placing a third tab of a first blank facing the first tab of the adjacent arris of the first blank, [b] placing a third tab of a second blank facing the first tab of the adjacent arris of the second blank, [c] placing the corresponding arrises of the first and second blanks folded according to steps [a] and [b] facing one another, [d] folding in the second fold-in tab of the first blank over the first tab of the second blank, [e] folding in the second fold-in tab of the second blank over the first tab of the first blank, [f] inserting the closure flange of the first and second blanks into the corresponding closure groove of the first and second blanks until said flange projects completely from the closure groove of the blank containing the corresponding flange which has been inserted.

Finally, and for applications requiring special compressive strength, said closure flange is at most as wide as said closure groove and comprises retaining grooves on each side of said flange forming retaining fingers, and the method comprises a step of lifting up said retaining fingers of said flange for retaining said flange with respect to said closure groove in a form-fit connection.

Likewise, the invention also comprises other detail features illustrated in the detailed description of an embodiment of the invention and in the attached drawings.

BRIEF DESCRIPTION OF THE DRAWINGS

Other advantages and features of the invention will be better understood from the following description in which several preferred embodiments of the invention are described in a non-limiting manner in reference to the attached drawings. In The drawings.

DETAILED DESCRIPTION OF EMBODIMENTS OF THE INVENTION

Figure 1:
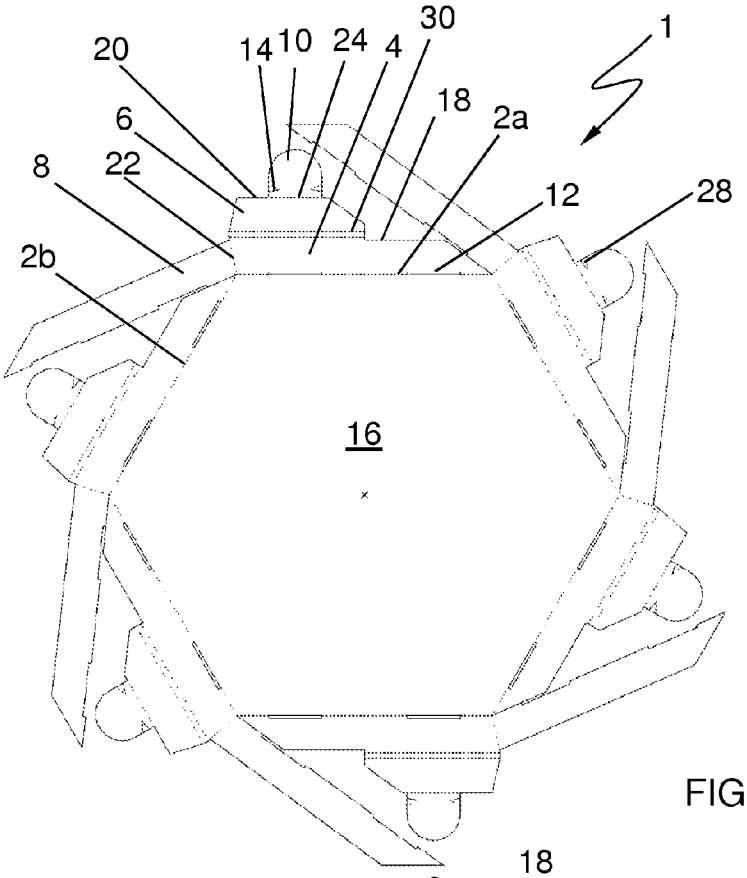
FIG. 1 shows a top plan view of a first blank according to the invention in the form of a regular hexagon.

FIG. 1 shows a first laminar blank 1 according to the invention. In this case, the blank 1 is a regular hexagon, i.e., a polygon having six arrises 2*a*, 2*b* of equal length.

As can be seen in FIG. 1, each laminar blank 1 comprises a main side 16 demarcated by six arrises 2*a*, 2*b*. A first fold tab 4 projects from each of the arrises 2*a*, 2*b*. This first tab 4 extends along the entire length of the corresponding arris 2*a*, 2*b* and forms a fold line coinciding with the respective arris when folded. Furthermore, in each arris 2*a*, 2*b* the blank 1 comprises in this case two closure grooves 12 on the arris 2*a*.

A second fold-in tab 6 projects from the first free edge 18 of each of the first tabs 4, facing the corresponding arris 2*a*, 2*b*, and extends partially along this first free edge 18 to form a double fold-in line 30. This fold-in line 30 is a double fold-in line particularly in the case of thick sheets, such as plastic sheets, for example, to compensate for the thickness of the sheets. The width existing between the two fold-in lines 30 will therefore depend on the thickness of the first and third tabs 4, 8. As seen in FIG. 1, the first free edge 18 of the first tab 4 is parallel to the corresponding arris 2*a*, 2*b*.

On the other hand, a closure flange 10 projects from the second free edge 20 of the second tab 6, facing the first tab 4, said flange extending partially along this second free edge 20. Again, This second free edge is parallel to the first free edge 18 and to the corresponding arris 2*a*, 2*b*. Furthermore, the height of the first and second tabs 4, 6 is virtually the same since the second tab 6 must take into account the thickness of the sheet forming the main side 16. The flange 10 is arranged aligned with the retaining groove 12 in which it will be inserted when assembling the polyhedron 100.

Finally, the blank 1 has a third tab 8 projecting from a side edge 22 of the first tab 4 and being foldable with respect to the first tab 4 along a fold line defined by the side edge 22 for cooperating with the adjacent arris 2*b*. In this embodiment, this third tab 8 has a length equal to the length of the adjacent arris 2*b* for offering maximum strength to the polyhedron 100 once it is assembled. As will be seen below, with this configuration it is extremely difficult for the polyhedron 100 to become disassembled by itself. Nevertheless, in alternative embodiments and depending on how small the magnitude of the loads that must be supported, the length of the third tab 8 could be half or even one third the length of the adjacent arris 2*b*.

Figure 2:
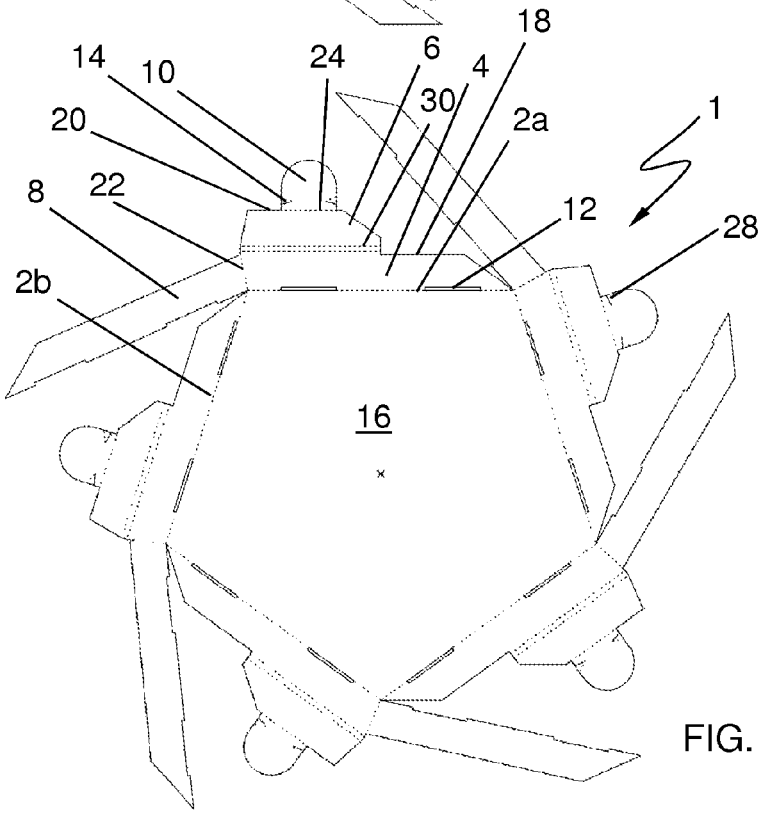
FIG. 2 shows a top plan view of a second blank according to the invention in the form of a regular pentagon.

In the preferred embodiment shown in FIG. 1 or 2, and which is particularly resistant to the compressive stresses on the polyhedron, the second fold-in tab 6 is adjacent to the third tab 8, such that the second tab 6 of the arris 2*b* can prevent the polyhedron 100 from disassembling when the tabs 8 of the arris 2*a* are covered and locked.

Finally, FIG. 1 shows the configuration of the flange 10 of this embodiment in detail. In this case, the closure flange 10 is as wide as the closure groove 12. Nevertheless, retaining grooves 14 are provided in the base 24 of the flange 10, on each side of said flange, said grooves being symmetrical and converging in the direction away from the base 24 forming retaining fingers 28. When assembling the polyhedron 100, the retaining fingers 28 can be raised once inserted in the corresponding closure groove 12 for attaching said closure flange 10 with the respective closure groove 12 in a form-fit connection. The retaining fingers 28 thus rest on the side of the first corresponding tab 4 preventing the polyhedron 100 from disassembling.

In turn, pressing the retaining fingers 28 to align them with the rest of the flange 10 is enough to disassemble an arris, undoing the form-fit connection and allowing the flange 10 to be removed from the corresponding closure groove 12.

FIG. 2 shows a second blank 1 in the form of a regular pentagon which, in this case, has a length of the arris 2*a*, 2*b* identical to the length of the arris 2*a*, 2*b* of the hexagon of blank 1 of FIG. 1. Furthermore as seen at a glance, all the features thereof are identical with the exception of the number of arrises 2*a*, 2*b* such that it allows being assembled with the blank of FIG. 1 in any relative position.

Evidently, the blanks 1 shown in FIGS. 1 and 2 are simply embodiments. Other alternative polygons could be a triangle, square, octagon or others.

The blank 1 according to the invention allows assembling a large number of regular and irregular polyhedra in a versatile manner. Particularly, it allows assembling a large portion of existing Archimedean solids in an easy manner, even though due to their configuration, those polygons having more than ten sides can complicate the assembly of the polyhedron 100. This would be the case of a truncated dodecahedron and a truncated icosidodecahedron.

Furthermore, the blank 1 according to the invention also allows assembling all platonic solids, i.e., convex polyhedra with equal, regular polygon sides which also comply with the condition of attaching at the vertices the same number of sides. Examples of these solids are a tetrahedron, cube, dodecahedron or icosahedron.

The method of assembling a truncated icosahedron, i.e., an Archimedean solid formed by twenty regular hexagons and twelve regular pentagons such as those shown in FIGS. 1 and 2, is shown below based on FIGS. 3 to 5.

Figure 3:
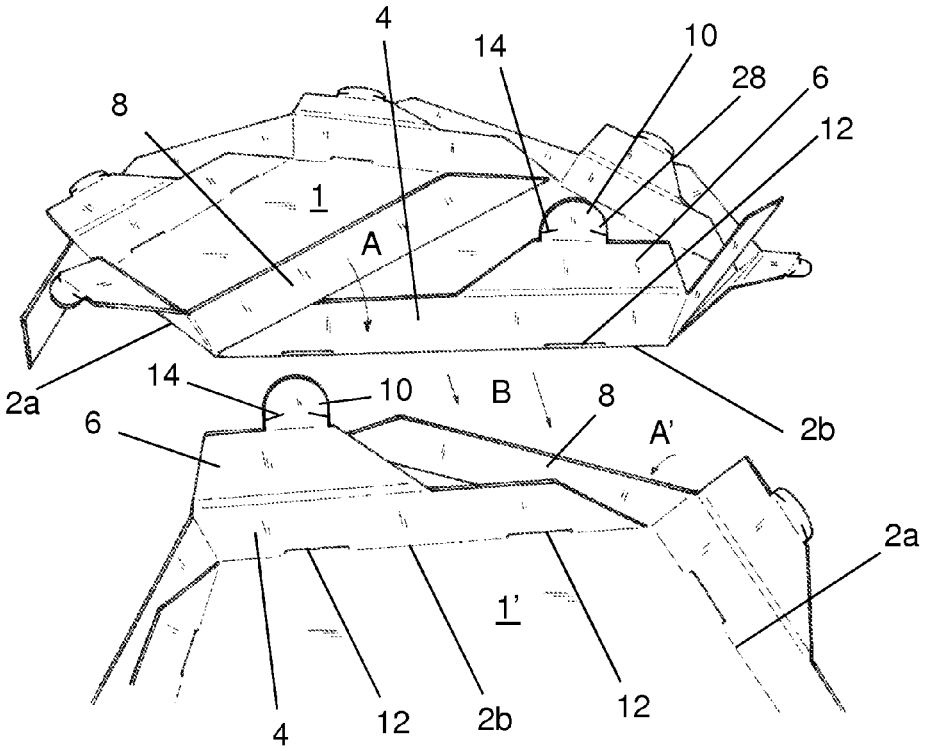
FIG. 3 to 5 shows detail perspective views of two blanks according to the invention while performing the method of assembling a polyhedron according to the invention.

The method of assembling the truncated icosahedron starts by placing the third tab 8 of a first blank 1 starting at the arris 2*a* facing the first tab 4 of the adjacent arris 2*b* of this same blank 1 in the direction of the arrow A of FIG. 3. The same operation is then performed for the second blank 1' to be coupled. The third tab 8 of the second blank 1' is thus placed facing the first tab 4 of the adjacent arris 2*b* of this second blank 1', in the direction of the arrow A' of FIG. 3.

Once this is done, the first and second blanks 1, 1' are placed facing one another in the direction of the arrow B of FIG. 3, supporting the set of first tabs 4 with the third tabs 8 overlapped as described in the preceding paragraph such that the arrises 2*b* of the respective blanks 1, 1' are aligned.

Figure 4:
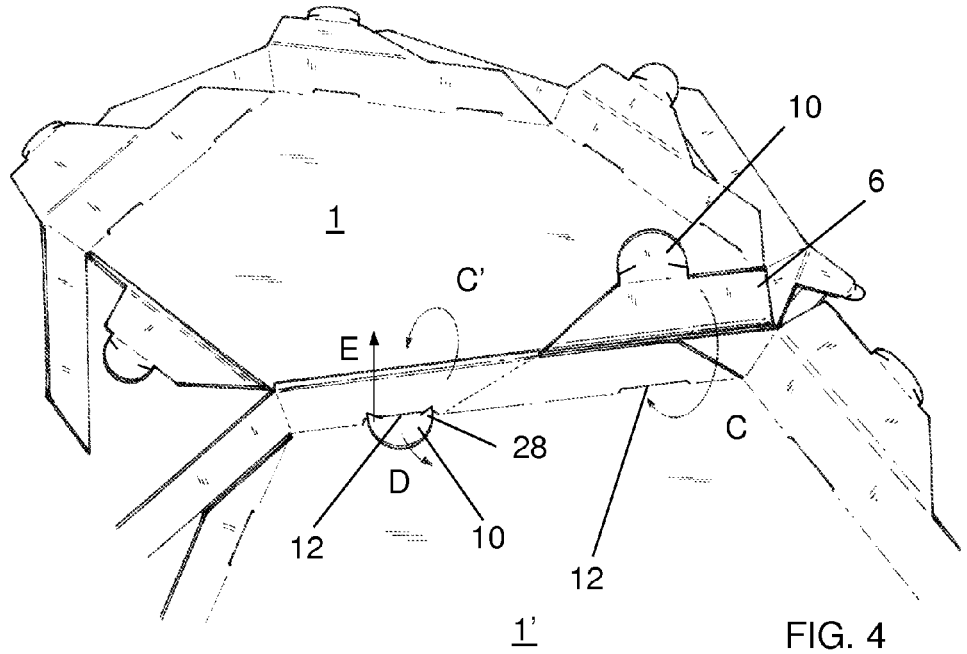
Figure 5:
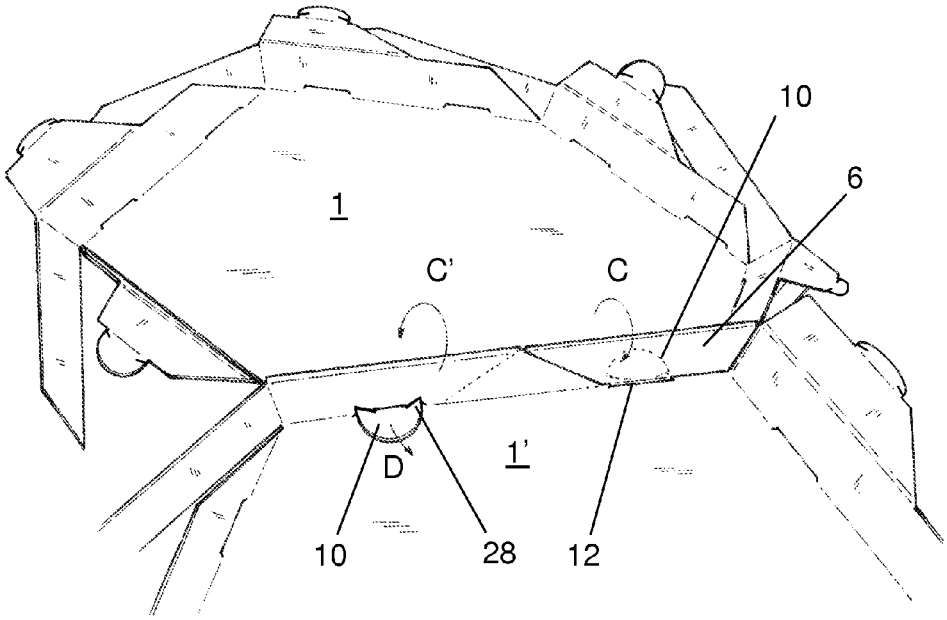

The second fold-in tab 6 of the first blank 1 must then be folded in over the first and third tabs 4, 8 of the second blank 1' in the direction of the arrow C of FIG. 4 or 5. This same operation is repeated for the second fold-in tab 6 of the second blank 1', folding it in over the first and third tabs 4, 8 of the first blank 1 in the direction of the arrow C' of FIG. 4 or 5. In the drawings, this second tab 6 is shown in its completely folded-in state, i.e., overlapping the first and third tabs 4, 8 of the first blank 1.

Finally and for stabilizing the attachment of the respective closure flanges 10 of the first and second blanks 1, 1', they are inserted into their corresponding closure groove 12. First, the flange 10 of the first blank 1 is inserted in the closure groove 12 of the second blank 1' and it then comes out through the closure groove 12 of the first blank 1 in the direction opposite that of the arrow D of FIGS. 4 and 5. When the base 24 of the flange 10 projects from the closure groove 12 of the first blank 1, the locking fingers 28 are lifted up in the direction of the arrow E of FIG. 4, whereby a form-fit connection is created between the flange 10 and its corresponding closure groove 12 of the first blank 1 itself and the disassembly of this arris 2 is accordingly prevented.

Figure 6:
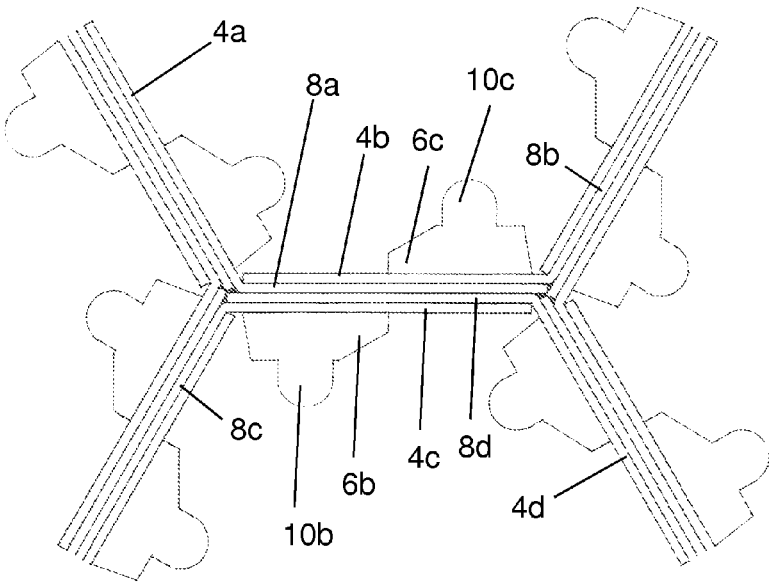
FIG. 6 shows a perspective view of a truncated icosahedron made from blanks according to the invention.

As can be seen in FIG. 6, which depicts a flattened view of an arris seen from inside the polyhedron before folding in the second tab 6, the final thickness of the finished arris results from the complete or partial juxtaposition of four thicknesses of the material of the blank, corresponding to the first and third tabs 4, 8 of two opposite arrises, plus the coverage of one side of the arris or the other assured by the second opposite tabs 6.

Therefore for the truncated icosahedron shown in the drawings, this operation is repeated for the 89 remaining arrises until the polyhedron 100 is closed as shown in FIG. 6. Using a small spatula may be useful to facilitate the insertion of the flanges 10 and to lift up the locking fingers 28.

The polyhedron 100 obtained by means of the blanks according to the invention is particularly resistant to compressive stresses. This is achieved as a result of the interaction of the different tabs of the blanks according to the invention and the distribution of stresses towards the arrises adjacent to the arris which receives the stress in particular.

Particularly, FIG. 6 allows clarifying the technical effect achieved by means of the blank according to the invention. When applying a compressive stress towards the center of the polyhedron on the arris in the center of the view, the third tab 8*a* of this figure transmits the bending stress towards the vertex of the arris 2 corresponding to the first tab 4*a* as a result of the third tab 8*a* resting on the fold-in between the first and second tabs 4*c*, 6*c*, whereas the third tab 8*d* in turn transmits the stress towards the vertex of the arris corresponding to the first tab 4*d* since the third tab 8*d* rests on the fold-in between the first and second tabs 4*a*, 6*a*. Therefore, the stresses are in turn distributed arris to arris towards the adjacent blanks, a closed and non-deformable hyperstatic structure being obtained.

Figure 7:
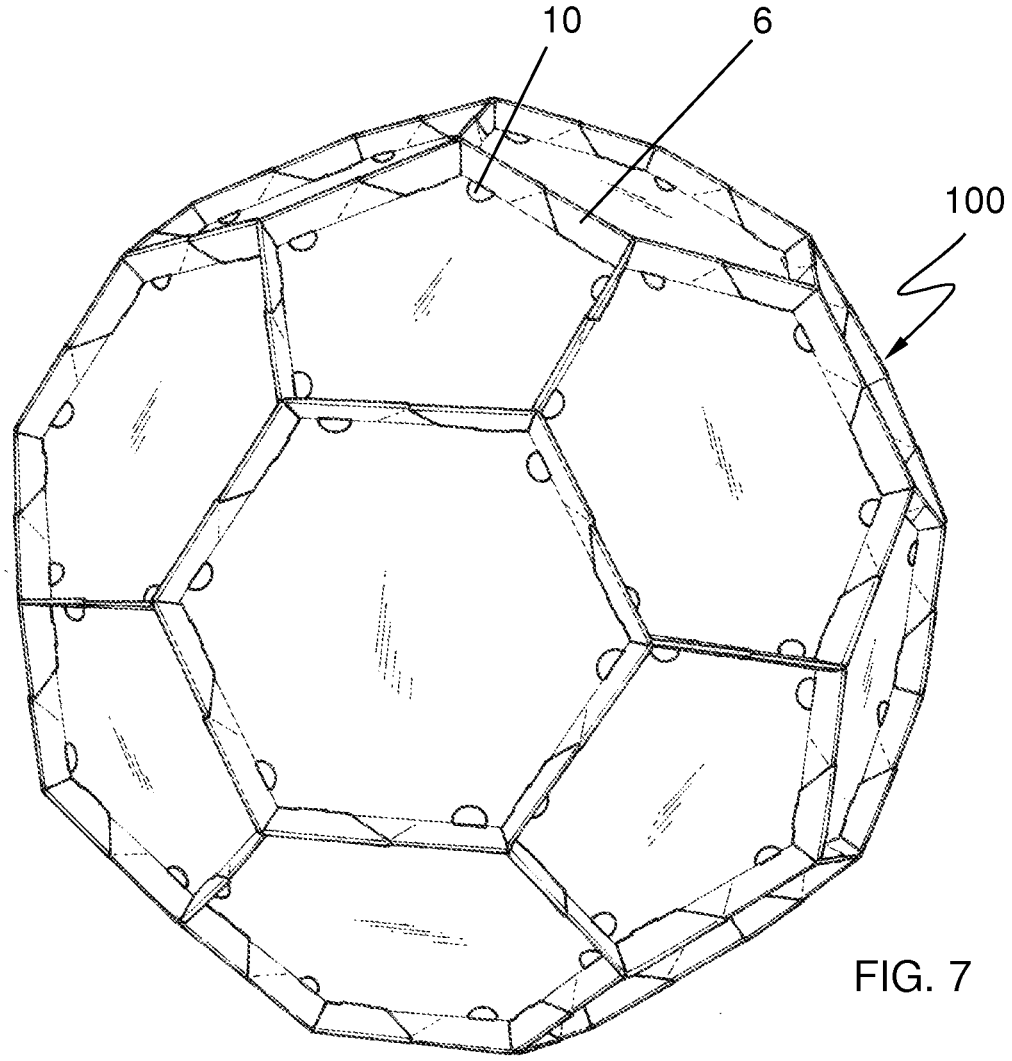
FIG. 7 shows a schematic plane view showing the assembled structure of two contiguous blanks according to the invention and particularly shows the insertion of two adjacent arrises into each end thereof by continuity in the body.
Figure 8:
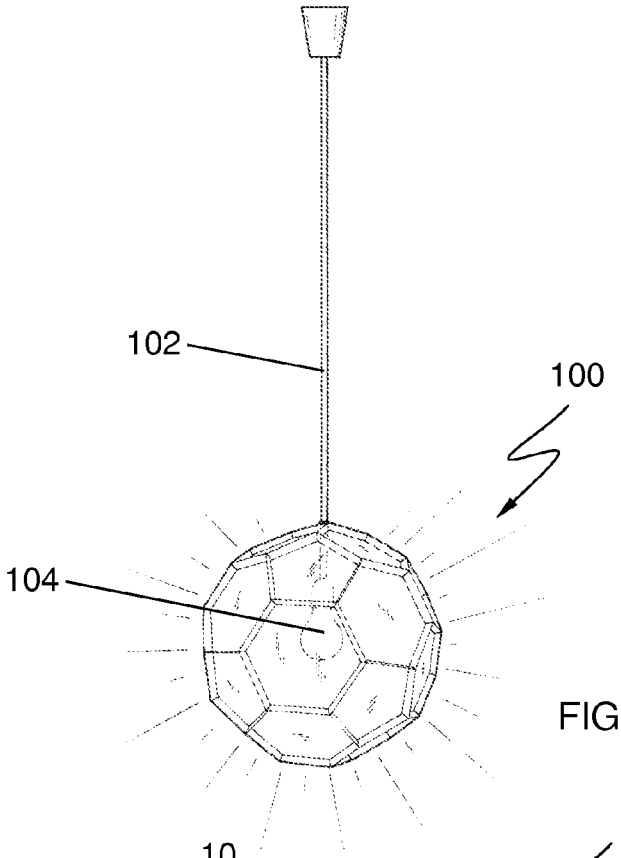
FIG. 8 shows a perspective view of a lamp made from a polyhedron according to the invention.

Therefore, the polyhedron 100 thus formed has several applications, such as containers, balls or the like. Hence in preferred embodiments, the blanks 1 can be translucent or transparent, for example. The blanks may also be perforated or non-perforated, or house graphics or hexagonal and pentagonal transparencies retained by the flanges 10. Furthermore, one of these blanks 1 can have an opening suitable for assembling lighting means 104 hung from a cable 102, creating the lamp shown in FIG. 7, or a floor or table lamp.

The invention also allows creating an assembly kit comprising a plurality of blanks according to the invention and not being limited to a particular geometric shape. This kit therefore comprises polygons from the group consisting of triangles, squares, pentagons, hexagons, octagons and decagons, making the kit highly versatile. Furthermore in a particularly preferred manner, the polygons of the kit are regular polygons.

Figure 9:
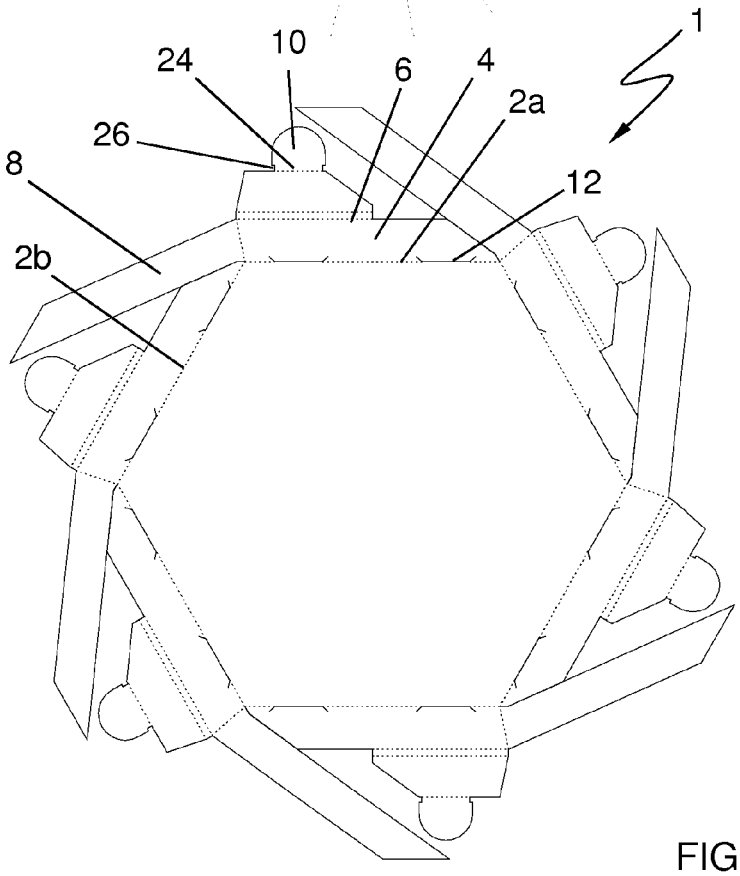
FIG. 9 shows a top plan view of an alternative embodiment of an blank according to the invention in the form of a regular hexagon.

Finally, FIG. 9 shows a second embodiment of the blanks according to the invention. As can be seen in FIG. 9, the difference in this case lies in the configuration of the flange 10. therefore, unlike the blanks 1 of FIGS. 1 and 2, the width of the flange 10 is greater than the width of the closure groove 12. Furthermore, the base 24 of the flange 10 has notches 26 on each side of the flange 10 instead of grooves 14 which define the fingers 28.

The invention claimed is:

1. A laminar blank for assembling polyhedra comprising:

at least three arrises, each of said arrises of said laminar blank comprising a first fold tab projecting from said arris, extending along an entire length of said arris to form a fold line, each of said arrises further comprising at least two closure grooves provided in said arris, a second fold-in tab projecting from an edge of said first tab facing said arris, each of said arrises further comprising a closure flange projecting from the edge of said second tab facing said first tab and extending partially along said edge, said closure flange being arranged aligned with one of said closure grooves, said second fold-in tab extending partially along said edge to form at least one fold in line;

a third tab projecting from one of side edges of the first tab, which has a length of at least one third a length of said adjacent arris and is foldable with respect to said first tab for cooperating with the adjacent arris, the arrises, the closure grooves, the second fold-in tab and the closure flange being configured such that the second fold-in tab of a first blank is foldable over the first tab of a second blank, the second fold-in tab of said second blank is foldable over the first tab of said first blank, and the closure flange of said first blank and said second blank is insertable into the corresponding closure groove of said first blank and said second blank until said closure flange projects completely from the closure groove of the corresponding flange which is inserted for attaching said flange and said groove in a form-fit connection.

2. The laminar blank according to claim 1, wherein said second fold-in tab is adjacent to said third tab.

3. The laminar blank according to claim 1, wherein said third tab has a length equal to the length of said adjacent arris.

4. The laminar blank according to claim 1, wherein said closure flange is as wide as said closure groove and said closure flange comprises retaining grooves on each side of said flange forming retaining fingers and said retaining fingers are symmetrical and converge in a direction away from said base and can be raised for attaching said closure flange with the respective closure groove in a form-fit connection.

5. The laminar blank according to claim 1, wherein a base of said closure flange is wider than said closure groove, the base comprising retaining notches on each side of said flange, said notches being symmetrical for attaching said closure flange with the respective closure groove in a form-fit connection.

6. A polyhedron, comprising a polyhedron structure assembled from a plurality of blanks, said blanks comprising at least three arrises, each of said arrises of said laminar blank comprising a first fold tab projecting from said arris, extending along an entire length of said arris to form a fold line, each of said arrises further comprising at least two closure grooves provided in said arris, and a second fold-in tab projecting from an edge of said first tab facing said arris and extending partially along said edge to form at least one fold-in line, each of said arrises further comprising a closure flange projecting from the edge of said second tab facing said first tab and extending partially along said edge, said closure flange being arranged aligned with one of said closure grooves, each of said arrises further comprising a third tab projecting from one of side edges of the first tab, which has a length of at least one third a length of said adjacent arris and is foldable with respect to said first tab for cooperating with the adjacent arris.

7. The polyhedron according to claim 6, wherein said blanks are translucent or transparent.

8. The polyhedron according to claim 7, wherein at least one of the blanks of said plurality of blanks comprises an opening suitable for assembling lighting means.

9. A method of assembling a polyhedron from a plurality of laminar blanks, the method comprising the steps of:

providing at least a first blank and a second blank, each of said first blank and said second blank comprising at least three arrises, each of said arrises comprising a first fold tab projecting from said arris, extending along an entire length of said arris to form a fold line, each of said arrises further comprising at least two closure grooves provided in said arris, and a second fold-in tab projecting from a edge of said first tab facing said arris and extending partially along said edge to form at least one fold-in line, each of said arrises further comprising a closure flange projecting from the edge of said second tab facing said first tab and extending partially along said edge, each of said arrises further comprising a third tab projecting from one of side edges of the first tab;

[a] placing said third tab of said first blank facing the first tab of the adjacent arris of said first blank,

[b] placing said third tab of said second blank facing the first tab of the adjacent arris of said second blank;

placing the corresponding arrises of the first blank and the second blank folded according to steps [a] and [b] facing one another;

folding in the second fold-in tab of said first blank over the first tab of said second blank;

folding in the second fold-in tab of said second blank over the first tab of said first blank;

inserting the closure flange of said first blank and said second blank into the corresponding closure groove of said first blank and said second blank until said flange projects completely from the closure groove of the blank containing the corresponding flange which has been inserted for attaching said flange and said groove in a form-fit connection.

10. The method of assembling a polyhedron according to claim 9, further comprising:

a step of lifting up said retaining fingers of said flange for retaining said flange with respect to said closure groove in a form-fit connection.

* * * * *